US006010540A

United States Patent [19]

Telesca et al.

[11] Patent Number: 6,010,540

[45] **Date of Patent: *Jan. 4, 2000**

[54] HOME DRYER DRY CLEANING AND FRESHENING SYSTEM EMPLOYING SINGLE UNIT DISPENSER AND ABSORBER

[75] Inventors: Josephine Telesca, Stamford, Conn.; Frank Anthony Lucia, III, Oak Ridge, N.J.

[73] Assignee: Reckitt & Colman Inc., Wayne, N.J.

[ * ] Notice: This patent is subject to a terminal disclaimer.

[21] Appl. No.: 08/665,469

[22] Filed: Jun. 18, 1996

[30] Foreign Application Priority Data

| | | | |
|---|---|---|---|
| Jun. 22, 1995 | [GB] | United Kingdom | 9512688 |
| Mar. 7, 1996 | [GB] | United Kingdom | 9604880 |

[51] Int. Cl.[7] ..... D06L 1/02; D06M 23/00; D06M 23/02

[52] U.S. Cl. ..... 8/142; 8/137; 510/281; 510/282; 510/283; 510/284; 510/285; 510/289; 510/291; 510/293; 510/295; 510/297; 510/298; 510/520; 510/523; 510/277

[58] Field of Search ..... 8/137, 142; 510/281, 510/282, 283, 284, 285, 289, 291, 293, 295, 297, 298, 520, 523, 277

[56] References Cited

U.S. PATENT DOCUMENTS

| | | | |
|---|---|---|---|
| 3,432,253 | 3/1969 | Dixon et al. | 8/142 |
| 3,813,221 | 5/1974 | Stubits | 8/142 |
| 3,859,225 | 1/1975 | McKnight et al. . | |
| 3,910,855 | 10/1975 | Abeles . | |
| 3,953,353 | 4/1976 | Barrett, Jr. et al. . | |
| 4,097,397 | 6/1978 | Mizutani et al. . | |
| 4,231,744 | 11/1980 | Moot | 8/495 |
| 4,336,024 | 6/1982 | Denissenko et al. | 8/142 |
| 4,430,468 | 2/1984 | Schumacher | 524/109 |
| 4,435,346 | 3/1984 | Ito et al. | 264/54 |
| 4,548,954 | 10/1985 | Smith et al. | 521/52 |
| 4,563,483 | 1/1986 | Smith et al. | 521/111 |
| 4,594,362 | 6/1986 | Smith et al. | 521/52 |
| 4,613,646 | 9/1986 | Sandvik | 524/476 |
| 4,632,772 | 12/1986 | Garabedian et al. . | |
| 4,670,171 | 6/1987 | Magyar . | |
| 4,680,143 | 7/1987 | Edge et al. . | |
| 4,685,930 | 8/1987 | Kasprzak | 8/139.1 |
| 4,720,351 | 1/1988 | Flynn et al. . | |
| 4,738,791 | 4/1988 | Ertle . | |
| 4,738,792 | 4/1988 | Ertle . | |
| 4,834,900 | 5/1989 | Soldanski et al. . | |
| 4,880,569 | 11/1989 | Leng et al. . | |
| 4,992,107 | 2/1991 | Itoku et al. | 134/27 |
| 5,205,960 | 4/1993 | Kristopeit et al. . | |
| 5,238,587 | 8/1993 | Smith et al. | 510/277 |
| 5,547,476 | 8/1996 | Siklosi et al. | 8/142 |
| 5,746,776 | 5/1998 | Smith et al. | 8/142 |

FOREIGN PATENT DOCUMENTS

| | | |
|---|---|---|
| 0 429 172 A1 | 5/1991 | European Pat. Off. . |
| 0429172 A1 | 5/1991 | European Pat. Off. . |
| 26 28 480 | 1/1978 | Germany . |
| 1 471 886 | 4/1977 | United Kingdom . |
| 1 536 936 | 12/1978 | United Kingdom . |
| 1 598 911 | 9/1981 | United Kingdom . |
| 1598911 | 9/1981 | United Kingdom . |
| 2 169 916 | 7/1986 | United Kingdom . |
| WO 91/14038 | 9/1991 | WIPO . |
| WO 95/31523 | 11/1995 | WIPO . |

*Primary Examiner*—Alan Diamond
*Attorney, Agent, or Firm*—Fish & Richardson P.C.

[57] ABSTRACT

A dry cleaning and freshening system is provided including a containment bag, a single unit dispenser having dispensing means, a container, and absorbing means. The container is adapted to contain a quantity of liquid cleaning composition. The single unit dispenser and absorber means includes a dispensing part with absorbent material and a container for holding liquid cleaning composition and a retaining part of absorbent material capable of entraining loose particles and/or absorbing excess liquid cleaning composition. The liquid cleaning composition may include a fragrance composition. In a preferred embodiment the single unit dispenser and absorber means may be in the form of a ball with two hemispheres that split and may be screwed together. The single unit dispenser and absorber means may be used in a home clothes dryer for dry cleaning.

20 Claims, 5 Drawing Sheets

HOME DRYER DRY CLEANING AND FRESHENING SYSTEM EMPLOYING SINGLE UNIT DISPENSER AND ABSORBER

This invention generally relates to a system for dry cleaning and freshening garments. More particularly the present invention relates to a dry cleaning and freshening system which utilizes a dryer apparatus, as well as a method of dry cleaning and freshening garments, particularly in a domestic setting.

Certain methods of dry cleaning and freshening garments have been described in the relevant prior art.

Smith et al., in U.S. Pat. No. 5,238,587, issued Aug. 24, 1993 discloses a method for cleaning soiled fabric articles comprising tumbling the soiled articles in a rotary clothes dryer at an elevated temperature, in a closed system, such as a sealed plastic bag. The system also includes a fabric-leaning article comprising a porous substrate sheet impregnated with a gel liquid cleaning composition. Such a system however is not without its shortcomings. When a gelling agent is used as the cleaning composition, a visible residue may be deposited on the garment to be cleaned. Further, a gel is only needed to coat sheets of material which do not otherwise absorb a sufficient amount of dry-cleaning composition. Additionally, when a gelled dry-cleaning composition is employed, a temperature sufficient to cause release of the dry-cleaning coating composition from the cleaning sheet is required.

Denissenko et al., in U.S. Pat. No. 4,336,024 issued Jun. 22, 1982 discloses a process for cleaning clothes at home with the aid of a solvent by treating the article of clothing with a cleaning agent comprising at least one organic solvent, and then laying the article of clothing flat on an absorbent sheet, and laying the article of clothing and absorbent sheet flat on the interior surface of a the drum of a washing machine in order to spin it. The process may be carried out in two successive stages using a stain-removing agent and a rinsing agent. The garments must however, be held against the sheet on the interior surface of the drum, where they of course are subject to the effects of gravity and thus require the use of clips or straps in order to retain their positions until centripetal forces retain them against the drum's inner wall surface.

In a further document, in U.S. Pat. No. 3,432,253 issued Mar. 11, 1969, to Dixon, therein is disclosed a dry cleaning process involving placing in an air impermeable bag a fabric to be cleaned and a quantity of substantially dry cleaning agent, sealing the bag, tumbling the bag to cause the cleaning agent to clean the fabric, removing the clean fabric from the bag and removing the cleaning agent from the fabric. The cleaning agent is removed from the fabric by continuing tumbling of the fabric outside of the bag. In the Dixon process, a flexible bag made of a material substantially impermeable to air leakage is employed. Dixon discloses the use of a conventional polyethylene bag. The bags are reuseable. When a substantially dry dry-cleaning agent is employed, as in the Dixon '253 patent, a finishing cycle to remove the cleaning agent is necessary. Further, the cleaning agent is carried by a vehicle such as fine sawdust or ground wood which must be collected in a suitable trap in the tumbling machine which is inappropriate for use with a home dryer without damaging the dryer. Further, the finishing cycle has all the disadvantages of friction damage and stretching of the fabric garment due to tangling of the garments during tumbling outside a bag.

However, each of these systems and compositions are not without their shortcomings.

Accordingly, there is a need for a dryer dry cleaning and freshening system employing an absorbent material which is capable of absorbing a sufficient amount of dry-cleaning fluid. Further, there is a need for a dryer dry cleaning and freshening system which does not result in the deposition of a visible residue on the garment to be cleaned. Additionally, there is a need for a dryer dry cleaning and freshening system employing low temperature levels.

There is a need for a dryer dry cleaning and freshening system which permits the amount of liquid cleaning composition to be controlled based upon the needs of the garment to be cleaned and the type of stain.

There is also a need for a reusable dispenser and absorber for use in dryer dry cleaning in order to reduce expense. There is a need for the above systems and dispenser and absorber for use at home.

It is a general object of the invention to provide a dryer dry cleaning and freshening system.

A further object of the invention is to provide a dryer dry cleaning and freshening system which is inexpensive and simple to use.

It is another object of the invention to provide a dryer dry cleaning and freshening system for use at low temperatures.

It is another object of the invention to provide a dryer dry cleaning and freshening system in which the amount of liquid cleaning composition may be controlled based upon the needs of the garment to be cleaned.

It is yet another object of the present invention to provide a single unit dispenser and absorber for use in dry cleaning and freshening, which may be used a number of times.

It is a still further object of the invention to provide a process for cleaning a soiled garment with a cleaning composition in a dryer.

It is an additional object of the invention to provide a process for freshening a garment with a freshening composition in a dryer.

It is another object of the invention to provide the above systems, processes and units for use at home.

These and other objects of the invention are accomplished by providing a single unit dispenser and absorber for use in dry cleaning and freshening comprising a dispensing part with absorbent material, a container means for holding liquid cleaning composition, and a retaining part of absorbent material capable of absorbing loose particles and excess liquid cleaning composition.

In a preferred embodiment of the invention, a dry cleaning and freshening system comprises a containment bag, a single unit dispenser means comprising a dispensing part with absorbent material, container means for holding liquid cleaning composition, and a retaining part with absorbent material capable of absorbing loose particles and excess liquid cleaning composition, optionally a further absorber means, and a quantity of a liquid cleaning composition.

In a further embodiment of the invention a process for cleaning a garment with a liquid cleaning composition comprises the steps of filling container means with a liquid cleaning composition, the container means located in a dispensing part of a single unit dispenser and absorber, the container means having openings therein for dispensing the liquid cleaning composition, placing at least one garment and the said single unit dispenser and absorber in a containment bag, fastening the containment bag, tumbling the containment bag and contents in a clothes dryer at low temperature, and removing the cleaned garment from the clothes dryer and containment bag.

In an additional embodiment of the invention, there is provided a process for freshening a garment with a fragrance composition comprises the steps of filling container means with fragrance composition, the container means located in a dispensing part of a single unit dispenser and absorber means, and the container means having openings therein for dispensing the fragrance composition, placing at least one garment and the single unit dispenser and absorber means in a containment bag, fastening the containment bag, tumbling the containment bag and contents in a clothes dryer at low temperature, and removing the freshened garment from the clothes dryer and containment bag.

The above recited objects as well ass further objects, aspects, features and advantages of the invention would be more readily apparent from the description of the preferred embodiments taken in conjunction with the accompanying drawings and appended claims.

It is to be understood that the invention is illustrated by way of example and not by way of limitation, and in the figures of the accompanying drawings like references denote like and corresponding parts and in which;

The dry cleaning and freshening system in accordance with the present invention includes a containment bag, a single unit dispenser and absorber means 1 and a quantity of liquid cleaning composition. The single unit dispenser and absorber means 1 comprises a dispensing part 2 with an absorbent material on at least part of its outer surface and an inner container for holding a quantity of a liquid cleaning composition. The single unit dispenser and absorber means 1 is shown generally in FIG. 1. The single unit dispenser and absorbing means 1 further includes a retaining part 3 having an absorbent material on at least part of its outer surface which is capable of absorbing loose particles and excess liquid cleaning composition. The absorbent material of the dispensing part and the retaining part 2 and 3, may be made of a variety of materials but are most preferably made of an absorbent foam, including for example foamable polymers. The single unit dispenser and absorber means 1 is also desirably shaped like a ball which splits into two parts as illustrated in FIG. 2. Desirably the dispensing part 2 is a hemisphere and the retaining part of absorbent material 3 is another hemisphere. The dispensing part 2 and the retaining part 3 of the single unit may be unscrewed and split or screwed together to form a ball. The dispensing part 2 and the retaining part 3 may be of different colors so to provide a visual indicator of these two parts.

The single unit dispenser and absorber means 1 of the invention has the advantage that it is reusable because the container may be refilled and the single unit dispenser and absorber means 1 may be placed in a washing machine to be cleaned.

Figure 3:
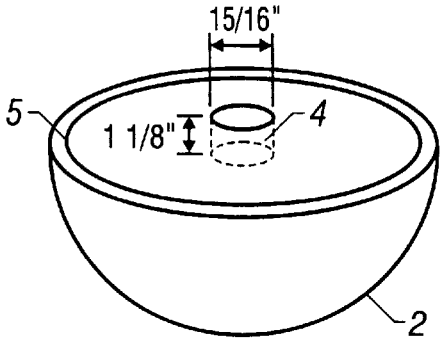
FIG. 3 is a schematic diagram of the absorbent material for the dispensing part of a single unit dispenser and absorber means in accordance with the present invention.

FIG. 3 illustrates the absorbent material of the dispensing part 2 of the single unit dispenser and absorber means of the present invention. A section 4 of a hemisphere of foam is cut out. Additionally an incision 5 is made from the edge of the foam hemisphere to receive a securing means mentioned below.

Figure 4:
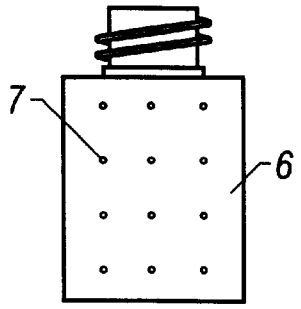
FIG. 4 is a schematic diagram of the container for holding liquid cleaning composition in the dispensing part of a single unit dispenser and absorber means in accordance with the invention.
Figure 5:
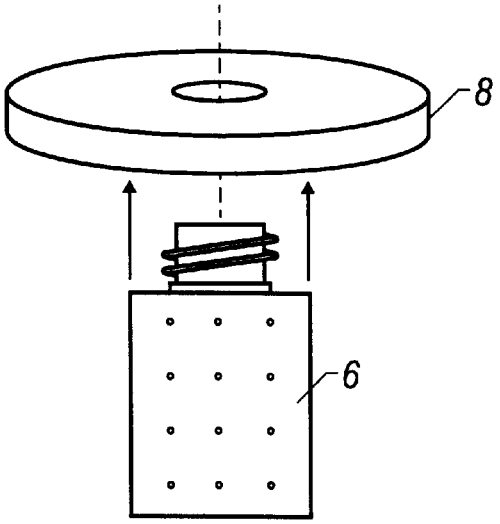
FIG. 5 is an exploded schematic diagram of the container for holding liquid cleaning composition and securing means which are a portion of the dispensing part of a single unit dispenser and absorber means in accordance with the invention.
Figure 6:
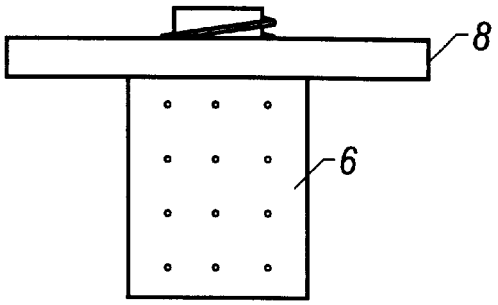
FIG. 6 is a schematic diagram of a container for holding liquid cleaning composition secured to securing means which are a portion of a dispensing part of a single unit dispenser and absorber means of the present invention.

FIG. 4 illustrates the container 6 embedded in the dispensing part 2 of the single unit dispenser and absorber means 1 of the present invention. The container 6 comprises one or more holes 7 which permit the passage of the liquid cleaning composition to exit and pass into the dispensing part 2. In such a manner, the one or more holes 7 in the container 6 permit passage of a liquid cleaning composition therethrough so to impregnates the dispensing part 2. In this embodiment, the container 6 is a plastic bottle having sufficient volume for containing approximately 0.25 ounce of liquid, but other larger and smaller bottles may be used. As illustrated in FIG. 5, the container 6 is attached to a securing means 8 which may be formed from any substantially rigid materials, such as a metal or a plastic. Herein there is illustrated a conventional metal flint glass jar lid having a suitably dimensioned hole roughly in its center so to receive a part of the container 6. The container 6 and the securing means 8 may be affixed together by the action of the cap (not shown) which is screwed onto the opening of the container 6, or the use of an adhesive such as an epoxy, thermoplastic glue or the like in order to further secure these two parts together. Ultimately, the container part 6 and the securing means 8 are affixed to one another in the configuration as is illustrated on FIG. 6.

Figure 7:
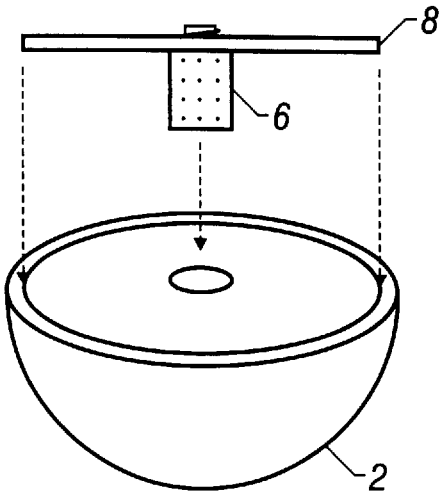
FIG. 7 is an exploded schematic diagram of the dispensing part of a single unit dispenser and absorber means in accordance with the present invention.

As is depicted on FIG. 7, the container part 6 and the securing means 8 are inserted into a hole provided for such a purpose in the dispensing part 2, which according to the preferred embodiment described herein is a foam hemisphere. Again, the use of an adhesive as described above may be used to secure the assembly. It is to be noted that the securing means 8 having a circular shape as illustrated is contributes to the maintainance of the overall shape of the dispensing part 2 as well as that of the single unit dispenser and absorber means 1 overall.

Figure 8:
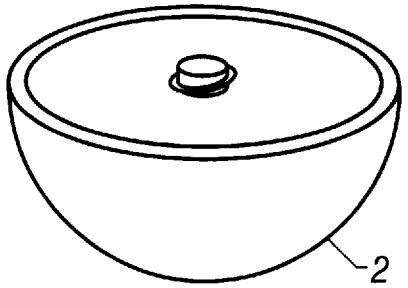
FIG. 8 is a schematic diagram of a dispensing part of a single unit dispenser and absorber means in accordance with the present invention.

FIG. 8 illustrates the fully assembled dispensing part 2 of the single unit dispenser and absorber means 1 of the present invention.

Figure 9:
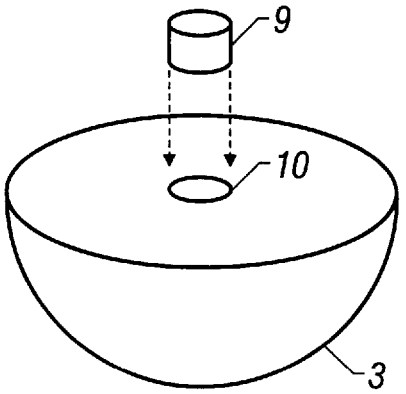
FIG. 9 is an exploded schematic diagram of a retaining part of a single unit dispenser and absorber means in accordance with the present invention.

FIG. 9 illustrates a preferred embodiment of a retaining part 3 which is desirably fabricated of absorbent material such as a polymeric foam as has been described above with reference to the dispensing part 2, and the retaining part 3 is desirably capable of entraning or entrapping loose particles and/or absorbing excess liquid cleaning composition. As is shown on FIG. 9, a recess 10 is present in this foam hemisphere forming the retaining part 3, which recess is dimesioned to receive a cap 9 appropriate for sealing the container 6. The cap 9 is inserted in the recess 10, and desirably an adhesive including those described above is utilized to secure the cap 9 to the retaining part 3. In such a manner, by screwing the cap 9 onto the container 6 in a conventional manner, the hemispherical absorbing part 2 and the hemispherical retaining part 3 are also connected to each other forming a spherically shaped a single unit dispenser and absorber means as is shown on FIG. 1.

It is to be understood however, than other releasable means may be used to releasably connect the absorbing part 2 to the retaining part 3 such as the use of conventional fastening means including by way of example, clips, pins, magnets as well as hook-and-loop type fasteners often referred to as Velcro fasteners.

Figure 1:
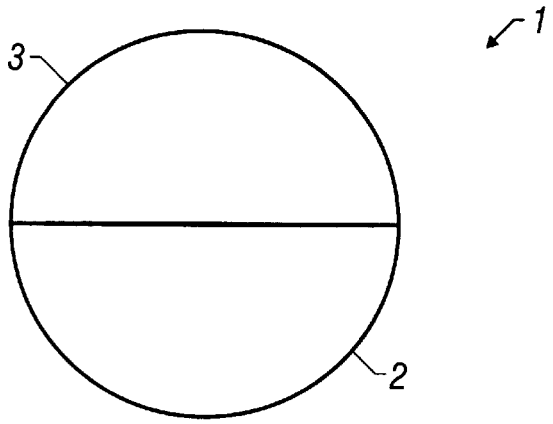
FIG. 1 is a schematic diagram of a single unit dispenser and absorber means having two hemispheres in accordance with the invention.
Figure 2:
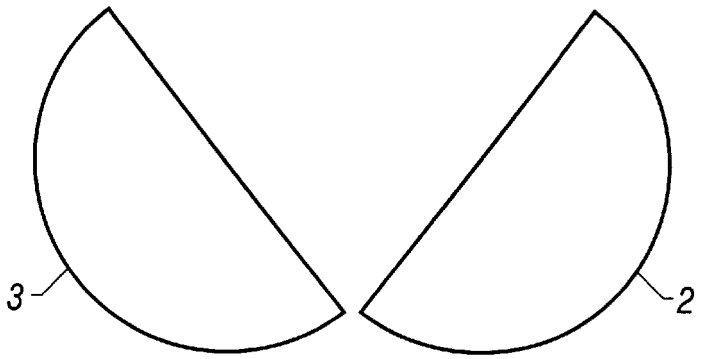
FIG. 2 is a schematic diagram of a single unit dispenser and absorber means according to the invention with the two hemispheres separated.
Figure 10:
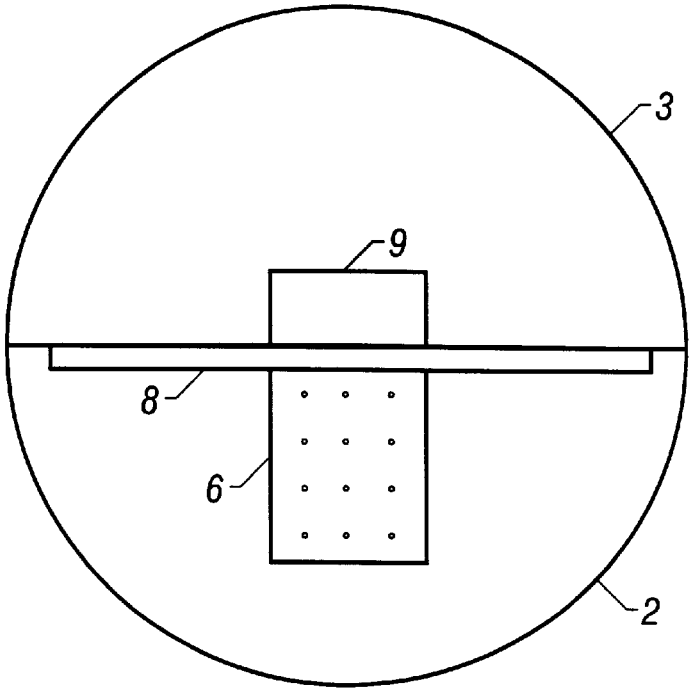
FIG. 10 is a translucent view (projection view) of a single unit dispenser and absorber means in accordance with the present invention.

FIG. 10 is a depiction of a translucent view of a single unit dispenser and absorber means of the present invention, and which generally corresponds to that illustrated on FIG. 1.

Figure 11:
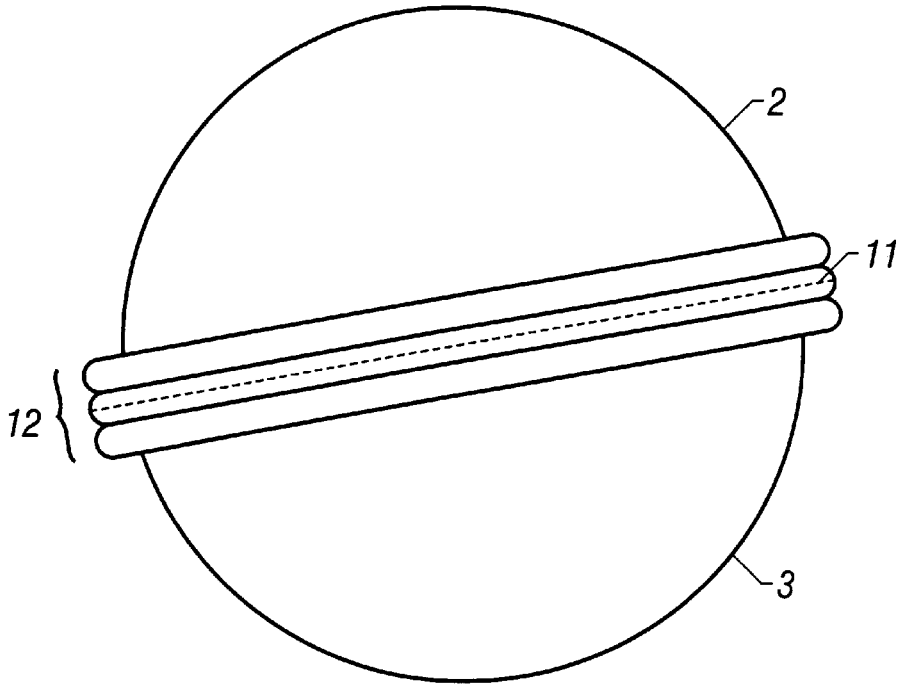
FIG. 11 is a schematic diagram of a single unit dispenser and absorber means in accordance with the present invention.

FIG. 11 is a schematic diagram of an alternative preferred embodiment of the single unit dispenser and absorber means 1 of the present invention. In FIG. 11 three rings generally indicated as 12 provide a grip for screwing and unscrewing the hemispherical dispensing part 2 and absorbing part 3, each made of an absorbent polymeric foam. Dashed line 11 indicates where this ball shaped single unit dispenser and absorber means 22 will separate into to approximately equal hemispherical parts when unscrewed or otherwise separated. Such rings 20 are desirably stiffer than the materials from which the dispensing part 11 and absorbing part 12 are made and thus contribute to retaining the overall shape of the single unit dispenser and absorbing means. Such rings for example, may be understood to be the edges of separate rigid disks, and it is also to be appreciated that only two disks may be present with one of each disks attached to either the dispensing part or the absorbing part. Although not shown, it is to be understood that the interior of this ball shaped single unit dispenser and absorber means includes a container 6 suitable for containing and releasing a quantity of a cleaning composition.

Figure 12:
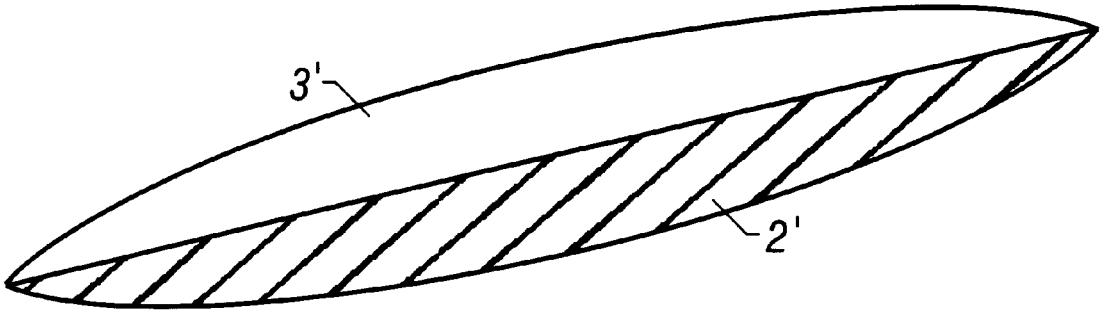
FIG. 12 is a schematic diagram of a saucer-shaped single unit dispenser and absorber means in accordance with the present invention.

FIG. 12 illustrates a still further alternative embodiment of a single unit dispenser and absorber means in accordance with the present invention wherein said unit is shaped as a saucer which splits into two parts: a dispensing part 2' formed of an absorbent material as described above, and a retaining part 3' of absorbent material also as described above. Although not shown, the single unit dispenser and absorber means includes a container suitable for containing and releasing a quantity of a cleaning composition within its interior, and that the dispensing part 2' and the retaining part 3' are releasably attachable to one another in the manner described in reference to the embodiment discussed on FIGS. 1–10.

In accordance with a process according to the invention. The single unit dispenser and absorber means described above is useful in conjunction with a dry cleaning and freshening system, which system further includes a containment bag and a quantity of liquid cleaning composition. The liquid cleaning composition may be provided in a separate flask or container from which it may be provided to the container 6 prior to use.

Figure 13:
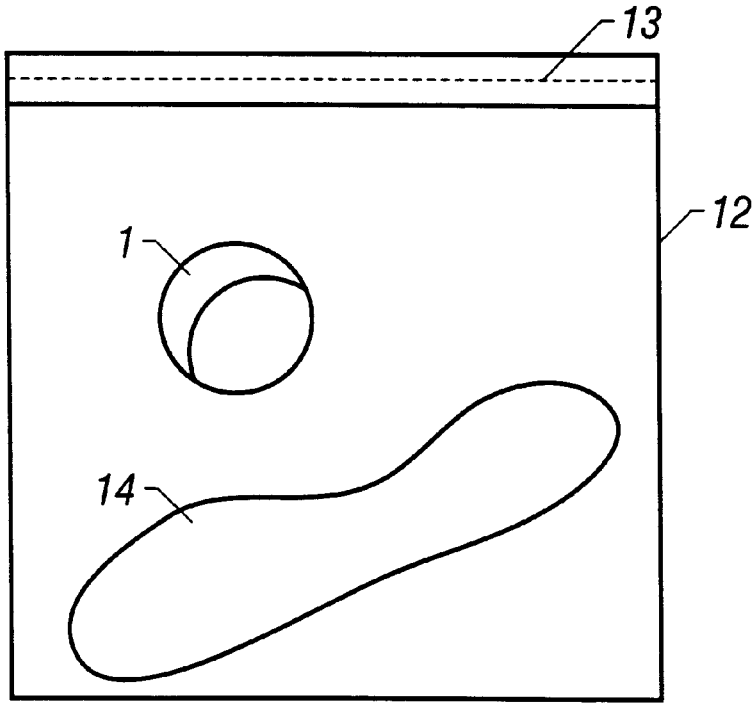
FIG. 13 is a schematic diagram of a single unit dispenser, and a containment bag according to the present invention.

FIG. 13 illustrates such a system including the single unit dispenser and absorber means 1 according to the embodiment shown in FIG. 1 and described in detail above, a containment bag 12 having fastening means 13, and for the sake of illustration a garment 14.

The containment bag 12 having an opening conveniently placed at one side thereof. With reference to containment bag 12 it may be fabricated of a material which is vapor impermeable material such as a plastic or polymer material such as from a sheet or film which is sewn, as well as certain non-woven textiles and formed materials, such as TYVEK (DuPont Corp., Wilmington Del.) and the like. Such a containment bag is typically sealed or otherwise fastened on one or more edges in order to form said containment bag 12, and any conventional means for its production may be used. Such sealing or fastening means include for example sewing, welding, melt-bonding as well as other conventionally known means. It is further to be understood that while a vapor impermeable material may be used in the construction of the containment bag 12, it is to be understood that such a bag itself need not be totally hermetically sealable itself and that the escape of vapors or gases from within such a containment bag 12 to its exterior, such as the interior space of a clothes dryer is to be foreseen. Such an escape of vapors may occur at seams of said containment bag 12, particularly where sewn seams are present, as well as from the opening. Alternately, the containment bag 12 may be fabricated of a material which is vapor permeable, such as a woven or non-woven textile material, which may be made of naturally occuring or synthetically produced fibers, as well as blends of two or more different materials. Both the vapor permeable materials and the non-vapor permeable materials may be a single layer material, or may be of a multilayer construction such as two or more layers of differing materials layered in register. Examples of such include a first layer of a non-woven material which is used in the innermost layers of the containment bag 12, which is in turn layered with a non-woven material such as a polymer film layer which desirably provides a vapor impermeable barrier layer to the containment bag. A second example of multilayer containment bag construction includes a first innermost layer which is a fibrous material, such as a non-woven material and a second layer in register therewith of a non-woven vapor impermeable synthetic paper-like material such as TYVEK material which is used to form the exterior of the containment bag 12. Such a construction provides the advantage of providing a vapor impermeable containment bag 12, which has a durable exterior layer which in turn increases the operating life of such a containment bag. Further, the exterior material made of TYVEK or a similar material is readily printable using known art techniques which permits the printing of a legend, logo or instructions for use on this exterior surface of the containment bag 12. A third preferred material of construction useful in the fabrication of a containment bag 12 is a two or three layered construction, wherein the first and innermost layer of the containment bag 12 is of a non-woven, fibrous material such as of a synthetically produced fiber, which in turn in bonded to a second spun bonded polymeric textile material, which imparts strength to such a containment bag construction. Optionally, but desirably a third layer of a non-woven, fibrous material is bonded to the remaining side of the spun bonded polymeric textile material and thus forms the exterior of the containment bag 12. The fibrous material used in the formation of this third layer may be of the same synthetically produced fiber of the first, innermost layer or it may be of a different fiber.

A further and most preferred material of construction for the fabrication of the containment bag 12 is a vapor impermeable or poorly vapor permeable bilayered material which has on its first layer a polymeric film, which is bonded to a second layer of a polymeric spun bonded nonwoven textile material. Both the polymeric film and the polymeric spun bonded nonwoven textile material may be produced from a variety of known art polymers and copolymers including for example nylons, polyallylene terephthalates, rayon, as well as polyalkylenes especially polyethylene, polypropylene and polybutylene being of particular advantage due to their low cost and ready fabrication into both vapor impermeable films as wall as nonwoven textile materials. The bonding between these layers may be accomplished by virtually any known means, including for example heat bonding, resin bonding which may require the use of a bonding material or film intermediate to the first film layer and second film layers, as well as ultrasonic bonding methods which provide effective binding between these two materials and which may be practiced to produce an attractive dimpled appearance on the final material. In accordance with this most preferred embodiment, the containment bag 12 is constructed such that the first film layer is forms the interior of the containment bag and thereby, and the second film layer forms the exterior of the containment bag 12. A first advantage of this most preferred containment bag 12 construction is that the interior film layer of the bag is both vapor impermeable and is nonabsorbent of the liquid cleaning composition and thus the maximum cleaning efficacy of these compositions is available to the clothes or other textiles being treated in the process according to the invention. A second advantage of the preferred construction is the inventors' observation that such a containment bag 12 billows sufficiently during the tumbling and heating it encounters in the dryer apparatus, yet permits the escape of vapors produced or entrapped within the containment bag to escape at an acceptable rate. A third advantage enjoyed by the preferred construction is the durability of such a containment bag 12 as the nonwoven film layer which forms the exterior of the bag is resistant to tearing, and at the same time the soft tactile characteristics of this layer make the bag especially attractive from the standpoint of the consumer.

Other advantageous materials of construction for the fabrication of containment bags 1 which are alternative especially preferred embodiments having a vapor impermeable or poorly vapor permeable bilayered material which has on its first layer a polymeric film, which is bonded to a second layer of a textile material include for example: a first vapor impermeable layer of a copolymer film for a film formed from a blend of polymers including for example: polyethylene terephthalate—polybutylene terephthalate; polyethylene terephtalate—rayon which are in turn bonded to second layer of a polymeric nonwoven textile material which may be for example: rayon, and spun bonded or melt blown polyethylene or polypropylene textile materials. Such materials of construction useful for the fabrication of containment bags 1 which may be produced from these immediately above recited include: a first layer of a polyalkylene film, such as polyethylene or polypropylene bonded to a second layer of a textile material based on a blend of rayon and polyethylene terephthalte; and, a first layer of a polyalkylene terephalate film, bonded to a second layer of a rayon textile material.

It is to be understood that in any of the constructions recited which include one or more polymeric materials, that minor amounts of conventional additives may be included in conventional amounts including but not limited to: colorants, heat stabilizers, ultraviolet stabilizers and filler materials. Such are, per se, known to the art.

Both the first layers and the second layers may be of the same or different thicknesses, and it is required only that the containment bag 12 formed from these materials be flexible. Most desirably however, the thicknesses of both the first and second layer are less than about 20 mils, more desirably the thickness of the first, preferably vapor impermeable layer is 5 mils and less, especially 3 mils and less, while the thickness of the second layer and any further layer is about 5 mils and less.

The dimensions of the containment bag 12 and its internal volume may vary considerably. Desirably however, the containment bag 12 is sufficiently large to contain at least one garment or textile to be treated, but preferably 2–3 such garments, as well as the absorber means being taught herein, while at the same time not be overly large and thus be inconvenient for use in a domestic dryer apparatus. Advantageously the containment bag 12 has a volume of about 75 liters or less, with sizes of about 50 liters, and about 30 liters being preferred.

The opening of the containment bag 12 is conveniently located at an edge of the containment bag 12, but it may be located elsewhere.. The opening may be a simple slit or discontinuity in the material of the bag's construction or it may take a more complex form such as further including a foldable flap to close the containment bag 12, or may also use fastening means 13. Suitable fastening means 12 may be any useful fastening means known to the art including, but not limited to one or more of the following: zippers, hook-and-loop type fasteners (VELCRO®), buttons, clips, pins, snaps, adhesive strips, as well as resealable plastic sealing elements such as two strips, one on each margin of the opening 2 when pressed together interlock to form a flexible seal. Such resealable plastic sealing elements are known to the art dealing with plastic bags and pouches, and are sometime referred to as ZIP-LOCK® type closures. Suitable fastening means 12 also includes the use of a simple drawstring to pull the opening 2 shut, the use of a single deformable wire-type "twist tie" to close the opening 2, as well as the use of one or more fastening means 12 in conjunction with a flap. Further conventionally known fastening means 12 although not elucidated here may also be used. In accordance with the convenient placement of the opening 2 at or near an edge of the containment bag 12, the fastening means 12 is placed at or about the edge of the bag as illustrated on FIG. 1. It is only required that the selected fastening means be affixable onto the materials of construction used to fabricate the containment bag 12, and that it form a relatively secure closure. Desirably, the containment bag 12 is closeable to provide a liquid seal to minimize the leakage of any liquid cleaning composition out of said bag and into the dryer, which in turn ensures that maximum cleaning effect is imparted to garments or other textile materials being treated.

In operation the container 6 is provided with an amount of a liquid cleaning composition, and the parts 2 and 3 respectively, are secured together by screwing the cap 9 onto the container 6. The single unit dispenser and absorber means 1 is placed in a containment bag 12 with at least one garment 14, and thereafter the said bag is sealed such as by the use of the fastening means 13. Wherein the containment bag is constructed from one of the preferred materials of construction as described above, a containment bag with a low vapor loss rate is provided as loss of the cleaning composition is expected only at the opening and along any seams of the containment bag 12 if such are not fully vapor impermeable. The thus loaded containment bag 1 is then inserted into a conventional domestic clothes dryer and tumbled at a low temperature, such as a conventional "delicate garments" for a sufficient period to ensure adequate cleaning and/or freshening of the textile and garments. Typically a period of about ten to twenty minutes on such a low temperature setting has been found to be adequate. During tumbling the liquid cleaning composition leaks out of the openings or holes 7 of the container 6 to impregnate the absorbent material of the dispensing part 2 with liquid cleaning composition and to dispense the liquid cleaning composition to the inside of the containment bag and to the garment. The retaining part of absorbent material entrains or entraps loose particles and/or absorbs any excess liquid cleaning composition The containment bag 12 is then removed from the clothes dryer and the garments and textiles are removed from the containment bag 12 and placed on a hanger. Both the single unit dispenser and absorber means 1 and the containment bag 12 may be retained for a subsequent cleaning operation, one or both may be discarded.

The dry cleaning system of the present invention may be employed using a conventional home rotary hot air clothes dryer. However, any device that can tumble the system while supplying low heat without dispensing water may be used.

Additionally, the dryer dry cleaning and freshening system of the invention may include a quantity of stain remover, which is sometimes referred to as a spot cleaning composition. Such a spot cleaning composition, interchangeably referred to as a stain remover is a composition intended to be used for the localized cleaning of a stain, as opposed to a general cleaning composition which is intended to be applied to a garment or textile's overall surface. In operation, the spot cleaning composition may be applied to a garment before placement in the containment bag, and useful spot cleaning compositions include those which are known to the art and which are found effective at cleaning stains. Such a composition may be provided in a conventional flask or sealed pouch. Further, in accordance with a further alternative embodiment of the system of the invention, there may also be included an additional quantity of a general cleaning composition in excess of that which is intended to be provided by the single unit dispenser and absorber means 1. Such an additional quantity of liquid cleaning composition which may be added to the containment bag and/or generally upon the surface of one or more of the garments to be cleaned before fastening the containment bag 12 and placing it in the clothes dryer for tumbling. Such a composition may be provided in a conventional flask or sealed pouch.

In a further embodiment, the single unit dispenser and absorber means 1 may be impregnated with a fragrance composition alone for freshening garments, exclusive of any cleaning composition.

The present invention is used in conjunction with a liquid cleaning composition. Typically such a liquid cleaning composition comprises one or more solvents and/or one or more surfactant constituents which may be employed to solubilize stains, and such cleaning compositions may be provided as part of an aqueous, or as part of an organic fluid delivery system. Compositions which comprise a fragrance constituent, with or without additional solvents and or surfactant constituents may also be used. Such surfactants and solvent, where present are generally known to aid in the removal of soils and stains from the garment or textile being treated in the process being taught herein. Exemplary useful liquid cleaning compositions include those which are known to the skilled practitioner in the art, and include those disclosed in any of the patents which are recited above, the contents of which are herein incorporated by reference. Exemplary useful liquid cleaning compositions include those which are known to the skilled practitioner in the art, and include those disclosed in any of the patents which are recited above, the contents of which are herein incorporated by reference. Further useful cleaning compositions which may be used include those which are the subject of copending patent application Ser. No. 08/666,689 which are liquid cleaning compositions which are particularly useful as a home dry cleaning composition. These liquid cleaning compositions comprising the following constituents: 0.01–5% wt. (preferably 0.01–2.5% wt.) nonionic surfactant which is preferably an alkoxylated primary or secondary alcohol and/or an alkoxylated phenol; 0.01–2.5% wt. anionic surfacant selected from alkyl sulfosuccinates, alkyl ether sulfosuccinates, alkylamide sulfosuccinates, alkyl sulfosuccinamates, as well as salt forms thereof; 0–1% wt. (preferably 0–0.1% wt.) fluorosurfactant constituent including one or more of those which may be present in the spot cleaning composition; 0.01–7% wt. organic solvent selected from alcohols and glycol ethers especially water miscible alcohols and ethers, to 100% wt. of water, and further up to about 2% wt. (preferably 0–1% wt.) of one or more optional constituents. Desirably, these compositions are aqueous in nature and comprise about 90% wt. and more of water. Further useful compositions are those which are taught as localized stain treating compositions, viz., spot treatment compositions which are described in Ser. No. 08/666,690. Therein are described aqueous spot cleaning composition which comprises the following constituents: 0.1–10% wt. nonionic alkoxylated alcohol; 0.1–10% wt. nonionic alkoxylated mono- and di-alkanol amide; 0.1–3.5% wt. anionic surfactant especially one or more selected from alkyl sulfosuccinates, allyl ether sulfosuccinates, alkylamide sulfosuccinates, alkyl sulfosuccinamates, as well as salt forms thereof; 0–1% wt. flurosurfactant; 0.01–7% wt. alcohol solvent especially water miscible alcohols; 0.01–30% wt. glycol ether solvent, especially water miscible glycol ethers; to 100% wt. water. Optionally, these spot cleaning compositions may include up to about 2% wt. of one or more conventional additives such as acids, bases, pH buffers, coloring agents, fragrances and the like. Desirably, these spot cleaning compositions comprise at least about 70% wt. water. The contents of both of these applications are herein incorporated by reference.

In summary, many known art compositions are useful such as those which include a proportion of one or more water miscible organic solvents such as one or more alcohols, polyols, ketones, or glycol ethers. Pyrrolidinone solvents are also known, as well as conventional chlorinated dry-cleaning solvent and mixtures of the foregoing as long as the final cleaning composition has a flash point above 160° F.

Many known art compositions include one or more surfactants, including nonionic surfactants as well as amphotheric solvents.

Exemplary nonionic surfactants include condensation products of ethylene oxide with a hydrophobic polyoxyalkylene base formed by the condensation of propylene oxide with propylene glycol. Preferred nonionic surfactants include the condensation products of $C_8$–$C_{22}$ alkyl alcohols with 2–50 moles of ethylene oxide per mole of alcohol. Preferred nonionic surfactants also include ($C_8$–$C_{24}$) fatty acid amides, e.g. The monoamides of a mixture of arachidic and behenic acid and the mono- or di-alkanolamides of ($C_8$–$C_{22}$) fatty acids. Further nonionic surfactants which may be employed include the ethylene oxide esters of $C_6$–$C_{12}$ alkyl phenols such as (nonylphenoxy) polyoxyethylene ether. Other nonionics include the ethylene oxide esters of alkyl mercaptans, the ethylene oxide esters of fatty acids and the lauric ester of methoxypolyethylene glycol, the ethylene oxide ethers of fatty acid amides, the condensation products of ethylene oxide with partial fatty acid esters of sorbital, wherein the mole ratio of ethylene oxide to the acid, phenol, amide or alcohol is about 5–50:1. Amphoteric surfactants many of which are known to the art, including ($C_8$–$C_{22}$) alkyl(dimethyl)amine oxides may also be present. Further useful amphoteric surfactants are known to the art, e.g., as disclosed in U.S. Pat. No. 3,936,538.

Certain general liquid cleaning compositions include certain cationic surfactants is referred to as quaternary amines, which have been found to function to function as fabric conditioners, reducing static cling and lint adherence. Also useful in certain general cleaning composition include certain imidazolinium salts and useful amine salts like the stearyl amine salts that are soluble in water.

Additionally water may be present in the liquid cleaning composition. Generally, sufficient water is employed to aid in the removal of water based stains.

The liquid cleaning composition and fragrance composition should be such that there is little or no skin and eye irritation and preferably, no toxicity. Preferably a sufficient quantity of liquid cleaning composition is provided to clean three garments per dry cleaning load.

The liquid cleaning composition should also exhibit a sufficiently low flash point so to minimize and for all intensive purposes eliminiate the likelihood of combustion when used in the cleaning process described above.

The liquid cleaning composition may include a fragrance, deodorant, preservative, insect repellent such as cedar oil, a coloring agent, finishing agents, funigants, lubricants, and fungicides, as long as the additives do not interfere with the operation of the composition. The liquid cleaning composition may also include amounts of a thickener or gelling agent.

As used in this specification the term "liquid cleaning composition" is to be understood to encompass cleaning compositions which may or may not include one or more "freshening" agents, typically one or more fragrances which are directed to provide a freshening effect. Alternately is it also to be understood that the "liquid cleaning composition" comprises one or more freshening agents, but no solvents and/or surfactant constituents for the solubilization of stains. In the case of the latter, the system and process of the invention generally provides only a freshening effect to garments being treated.

As used throughout this specification and in the claims, the use of the terms "garments" and "textiles" are used to describe for example finished articles such as pants, shirts, blouses, scarves, other articles of clothing, apparel, coats, and the like. In the case of the former term, while in the case of the latter term, textiles which are produced but have not been as of yet produced into either pieced goods or finished articles such as articles of clothing or apparel is intended to be meant by the latter term. In either case, as the present invention is equally applicable and useful without distinction or regard for both textiles and/or garments, they are to be understood as to interchangeable terms with respect to the cleaning operations and cleaning compositions according to the instant invention.

What is to be understood by the term as "dryer" or "dryer apparatus" is a rotary dryer which generally is typical of a domestic rotary dryer. The only requirement is that the drum be configured so as to retain garments and/or textiles therein, to be rotatable, and that the interior of the drum may be heated to at least the temperature at which the lowest boiling point constituent volatilizes. Domestic clothes dryers, as well as commercial clothes dryers, particularly of the rotary type and most particularly those which rotate about a non-vertical axis are to be clearly understood as encompassed within the scope of the instant invention.

Although the invention has been described with reference to the preferred embodiments, it will be apparent to one skilled in the art that variations and modifications are contemplated within the spirit and scope of the invention. The drawings and the description of the preferred embodiments are made by way of example rather than to limit the scope of the invention, and it is intended to cover within the spirit and scope of the invention all such changes and modifications.

We claim:

1. A dryer dry cleaning and freshening system comprising:

a containment bag; and, a two-part single unit dispenser and absorber means having first and second parts, and containing a quantity of a liquid cleaning composition, wherein said first part is detachable from said second part.

2. The dryer dry cleaning and freshening system of claim 1, wherein said first part of said two-part single unit is a dispensing part, and said second part is an absorbing part.

3. A dryer dry cleaning and freshening system according to claim 2, wherein the dispensing part comprises an absorbent material.

4. A dryer dry cleaning and freshening system according to claim 3 wherein the absorbent material of the dispensing part is a foamed polymer.

5. A dryer dry cleaning and freshening system according to claim 2, wherein the absorbing part comprises an absorbent material.

6. A dryer dry cleaning and freshening system according to claim 5 wherein the absorbing material of the absorbing part is a foamed polymer.

7. A dryer dry cleaning and freshening system according to claim 1 wherein the single unit dispenser and absorber means comprises a container having at least one opening permitting passage of a liquid composition from the interior of the container to the dispenser means.

8. A dryer dry cleaning and freshening system according to claim 1, wherein said containment bag is fabricated of a vapor impermeable material.

9. A dryer dry cleaning and freshening system according to claim 1 wherein said containment bag is formed of a first layer of a vapor impermeable polymeric film bonded to at least a second layer of a woven or nonwoven textile material.

10. A dryer dry cleaning and freshening system according to claim 9 wherein said containment bag is formed of a first layer of a vapor impermeable polymeric film bonded to at least a second layer second layer of a polymeric spun bonded nonwoven textile material.

11. A dryer dry cleaning and freshening system according to claim 1 wherein said containment bag is formed of a first layer of a non-woven material bonded to at least a second layer of a vapor impermeable polymeric film.

12. A dryer dry cleaning and freshening system according to claim 1, wherein said containment bag includes a fastener.

13. A dryer dry cleaning and freshening system according to claim 12, wherein said fastener is selected from zippers, hook-and-loop fasteners, buttons, clips, pins, snaps, adhesive strips, and resealable plastic sealing elements.

14. A dryer dry cleaning and freshening system according to claim 1, which system further includes a container which comprises a quantity of stain remover.

15. A dryer dry cleaning and freshening system according to claim 1, which system further includes a container which comprises an additional quantity of liquid cleaning composition.

16. A dryer dry cleaning and freshening system according to claim 1, wherein the liquid cleaning composition further includes a fragrance composition.

17. A process for cleaning a garment with a liquid cleaning composition comprising the steps of:

placing at least one garment, and a two-part, single unit dispenser and absorber means having first and second parts, and containing a liquid cleaning composition in a containment bag, wherein said first part is detachable from said second part;

sealing said containment bag;

tumbling said containment bag and contents in a clothes dryer; and removing the cleaned garment from said clothes dryer and from the containment bag.

18. The process according to claim 17, further comprising the process step of:

prior to the insertion of at least one garment into the containment bag, applying directly to the surface of the at least one garment a quantity of the liquid cleaning composition.

19. The process according to claim 17, further comprising the process step of:

prior to the insertion of the at least one garment into the containment bag, treating the surface of said garment with a spot cleaning composition.

20. The process according to claim 17:

wherein the tumbling of the containment bag containing the at least one garment occurs for about 10 to 20 minutes.

* * * * *